United States Patent [19]

Goss

[11] Patent Number: 4,930,582

[45] Date of Patent: Jun. 5, 1990

[54] ROAD GRADER ATTACHMENT

[76] Inventor: George T. Goss, Rte. 3, Box 360, Picayune, Miss. 39466

[21] Appl. No.: 254,251

[22] Filed: Oct. 6, 1988

[51] Int. Cl.[5] ..... E02F 3/76

[52] U.S. Cl. ..... 172/788; 172/817; 172/821; 172/798

[58] Field of Search ..... 172/832, 817, 834, 818–822, 172/811, 789, 788, 791, 793, 830, 831, 828, 292; 280/11, 797–799; 37/108 R

[56] References Cited

U.S. PATENT DOCUMENTS

| | | | |
|---|---|---|---|
| 1,569,011 | 1/1926 | Gilbert | 172/817 X |
| 2,620,203 | 12/1952 | Love | 280/80 R X |
| 2,698,491 | 1/1955 | Felt | 172/830 |
| 3,027,662 | 4/1962 | Cunningham, Jr. | 172/832 X |
| 3,262,715 | 7/1966 | Abbott | 280/677 X |
| 4,246,972 | 1/1981 | Halmosi et al. | 172/789 |
| 4,501,334 | 2/1985 | Ptacek | 172/832 |
| 4,635,730 | 1/1987 | Larsson | 172/788 |

FOREIGN PATENT DOCUMENTS

| | | | |
|---|---|---|---|
| 0087410 | 6/1959 | Denmark | 172/834 |
| 1108454 | 8/1955 | France | 172/832 |
| 2312932 | 12/1976 | France | 172/834 |
| 0123779 | 12/1958 | U.S.S.R. | 172/832 |

*Primary Examiner*—Jeffrey L. Thompson
*Attorney, Agent, or Firm*—Alexander F. Norcross

[57] ABSTRACT

A grader attachment is a forward extending triangular truss structure, which extends from a point of pivotal attachment to a tractor to a tandem front wheel support. A blade frame pivotally hangs from the peak of the truss, supporting a cutter blade immediately beneath the truss. The blade frame is capable of both lateral rotation an tilt. Blade positioning provides lateral forces for sliding the blade from side to side, and a rotational force for turning the blade so as to provide for a left or right leading edge cut. The blade describes, as it is moved, a cutting line tangent to a circle of large radius. The blade is supported through a long lever arm, increasing the stability of the blade position. The tractor raises and lowers the blade by tilting the entire truss. The apparatus is steered by the steering wheels of the tractor. An optional front wheel tilt mechanism aids in establishing a smooth curve cut, and may be implemented without the necessity of interconnecting the tractor steering with the grader attachment. The general lightweight of the structure, which permits it to be readily lifted above the line of the tractor, permits blade motion which a standard motor grader is incapable of.

12 Claims, 2 Drawing Sheets

854251

ROAD GRADER ATTACHMENT

BACKGROUND OF THE INVENTION

Road grader attachments to adapt relatively short wheel-base four wheel tractors for smoothing and grading road beds and the like are known in the art. Each such attachment attempts to, as best as possible, achieve the results of a dedicated road grader where a relatively long spaced wheel base has a movable positional scraper blade mounted intermediate the front and the rear wheels.

Since the purpose of a grader is to smooth an uneven ground surface, the geometry of any practical grader must address the problem of grading an average slope based on the position of the vehicle itself as it traverses the ungraded or the partially graded terrain. It has long been known that a long wheel base is advantageous in damping out small undulations in the ground while still preserving a track for the blade roughly approximate to the average terrain and slope of the ground. The blade in this case acts as a cutting device cutting an average slope of smoother characteristics in the preceding ground.

It is equally well known that a long wheel base severely inhibits the mobility and maneuverability of a rough terrain machine, and thus a relatively short wheel base of a tractor is considered advantageous for providing easy maneuverability of the tractor and its attachments over rough ground. Thus, in tractors, a short wheel base is advantageous, providing high maneuverability.

Therefore, it is advantageous that a grader attachment for a tractor, which has a relatively short wheel base, should somehow increase the smoothing effect over that which will be achieved by merely putting a scraper blade on the front of a tractor in the manner of a common bulldozer.

Thus, U.S. Pat. No. 4,236,587 discloses a towed groundwork apparatus and hitch in which a scraper blade is mounted through an upper and a lower link so that the tool or scraper blade moves vertically independently of the rear wheels of the vehicle. An extended arm connects the tool to a trailing rear wheel to provide a leveling frame for positioning the tool on the already smoothed ground.

U.S. Pat. No. 3,881,563 discloses a grader attachment for tractors having an elongate frame ending in a single front wheel and axle structure, which is steerable. A scraper blade attachment structure positions the scraper blade between the front wheels of the apparatus and the rear wheels of the tractor. A mechanism raises the front wheel of the tractor off the ground so that the apparatus may be steered through the attachment's front wheel. The overall geometry of the invention emulates, as closely as possible, the geometry of a standard long frame road grader.

U.S. Pat. No. 3,716,105 discloses an attachment structure having an elongated extension for attaching on the front of a tractor. This patent discloses the use of a dual wheel front wheel pivoted about an axis midway between the front and the rear wheels for damping minor undulations which otherwise would effect the position of the front wheels. The twin wheel structure tends to assume a position intermediate local high and low spots; the front axle, which positions the front of the grader device, is always located intermediate the local higher and lower positions.

Thus with the exception of U.S. Pat. No. 3,881,563 nothing in the prior art maintained a fixed long wheel base on a rigid frame for the grader or scraper mechanism. Rather, these particular structures flex with the attendant lack of smoothness that could be obtained by a long wheel base grader.

Each such device shows a structure in which the mount of the grader blade is that encountered upon a standard road grader. The grader is provided with a circular or closed framework, rigidly mounted for vertical positioning on the frame, which in turn rotates the blade. The blade is tilted for grading by tilting the rotational assembly, usually by providing that the entire blade rotational assembly is mounted to the main frame of the unit through a plurality of powered actuators which are individually extended or retracted to achieve a tilt. This produces a structure in which blade movement and the reacting forces upon the blade are tightly coupled into the -support structure which positions the blades, and can produce a chattering or washboard effect on the graded surface.

SUMMARY OF THE INVENTION

This invention relates to the field of relatively light weight grading attachments for four wheel tractors, which attachments are readily mounted and dismounted.

In contrast, U.S. Pat. No. 3,881,563 in extending the length of the frame of the tractor, a long wheel base is achieved, but the relatively heavy weight of the structure makes it difficult, if not impossible to rapidly convert back to a short wheel base tractor. Raising the structure above the tractor would result in severe instability due to the massive weight required of the grader blade mechanism disclosed in this patent.

Typical tractors which should be kept in mind in the discussion of the invention range from small 30 h.p. tractors (such as a CUB) to large front loader units such as the Hydro-AX HARRICANA ®. While the exemplar model described here is of a mid-size, such as John Deere Model 455E or the John Deere Model 849. The invention may be sized over a considerable range of tractor sizes, and is the only structure known to the inventor which can be sized to fit small tractors. Thus we refer to the attachment of being relatively light weight, relatively being defined in comparison with the overall lifting weight and capacity of the supporting tractor. It is a material part of the invention that the apparatus, for whatever tractor it is designed, will be of a sufficiently light weight that it can be raised well clear of the ground without imposing.severe instabilities upon the operation of the tractor.

The invention discloses a structure in which a grader attachment is mounted to the front of any of a wide range of sizes of tractors having first positioning cylinders for raising and lowering a front end hitch and a second set of positioning cylinders for tilting the front end hitch in a forward or an aft direction. This structure is widely available to a Front End Loader mechanism.

Pivotally mounted to this attachment is a forward extending truss structure. The truss extends from a high vertical end near the point of pivotal attachment to the tractor to a lower front support wheel end. Preferably a tandem front wheel structure or oscillating wheels, which can be tilted, supports this lower front end of the half truss.

A blade hanger frame assembly, pivotally supported at the peak of the truss, hangs vertically down, supporting a cutter blade immediately beneath the truss. The pivot support is capable of both lateral rotation and tilt.

A lower blade positioning means connects with the blade providing lateral forces for sliding the blade from side to side, and a rotational force for turning the blade so as to provide for a left or right leading edge cut. The entire weight of the blade and its positioning equipment, however, is supported from the vertical pivot support and the motion of the blade is with respect to the motion about the vertical pivot support; thus, the blade describes, as it is moved, cutting a line tangent to a circle of large radius rather than rotating about a point within the blade.

As a result of this structure, the blade is supported and moved through a relatively long lever arm, reducing the forces upon the blade positioning apparatus and increasing the stability of the blade position. The structure removes the requirement for a lift apparatus for raising and lowering the blade; the tractor attachment positioning cylinders serve to raise and lower the blade by tilting the entire truss structure. Nonetheless, the actuators at each position maintain the entire tractor-attachment structure as a single, rigid, long wheel base apparatus. The tandem front wheels dampen the effects of minor undulations in the ground and the overall structure maintains a suitably long base line arm for producing a smooth grading cut.

The apparatus is steered by the steering wheels of the tractor, eliminating the necessity of a steering mechanism installed on the tandem support, or of interconnecting the tractor controls with the grader attachment; this considerably simplifies the mechanism. An optional front wheel tilt mechanism aids in establishing a smooth curve cut, and may be implemented without the necessity of interconnecting the tractor steering with the grader attachment.

The general lightweight of the structure, which permits it to be readily lifted above the line of the tractor, permits blade motion which a standard motor grader is incapable of. The unit is capable of raising the blade to a significant height. This can be a particular advantage, as for example, when it is necessary to level and grade a pile of gravel or dirt which has been dumped, as from a dump truck. A standard motor grader, which by the limits of its mechanism has only a limited height to which it can raise the blade, cannot attack a steep pile directly but rather has to grade at it from the side until such time as it has been knocked down to the point where the motor grader can drive over it. By contrast, the invention described here can simply be raised to the point that the blade can readily scrape the top off the pile until it is low enough that it can be graded in the regular grading position. The inventor considers this a unique feature of the invention.

Moreover, this ability to raise the grader structure vertically clear of both the ground and the level of the tractor permits the tractor to be turned essentially in its own short radius. This produces a unique situation in which a structure having the long wheel base and stability of a motor grader in a first position can be placed into a second, short wheel base position for high maneuverability, essentially turning in the middle of a standard two-lane road within its own wheel base length. Again, a practical motor grader having the wheel base equal to the wheel base of the invention here disclosed post tractor is incapable of turning in its own length and must find a significantly large area within which to turn around. Maneuverability which can be achieved by the structure of this invention is essential in speeding up grading operations within tightly confined spaces.

It is thus an object of this invention to disclose a motor grader attachment which is capable of providing a relatively long wheel base rigid grader geometry for providing a smooth graded surface, while also providing a second, short wheel base geometry for easy maneuverability and turning in confined areas.

It is a further object of this invention to disclose a long wheel base motor grader attachment which is capable of being raised to achieve an initial grader cut at a higher level than is possible with a fixed wheel base motor grader.

It is thus an object of this invention to disclose a tractor grader attachment which may be more readily mounted and demounted to a tractor than the prior art.

It is a further object of this invention to disclose a tractor grader attachment which provides a more stable mount in support for the grader blade than the prior art.

It is a further object of this invention to disclose a tractor grader attachment having substantially less physical mechanism directly adjacent to the blade and therefore, providing substantially greater visibility to the operator at the actual point of grading cut.

It is a further object of this invention to disclose a tractor grader attachment which simplifies the interconnection and steering of the entire tractor-grader combination.

It is a further object of this invention to disclose a tractor grader attachment which provides a greater degree of control to the tractor operator in operating the attachment.

These and other objects of the invention can be more clearly seen from the detailed description of the preferred embodiment which follows.

DETAILED DESCRIPTION OF THE PREFERRED EMBODIMENT

Figures 1, 2:
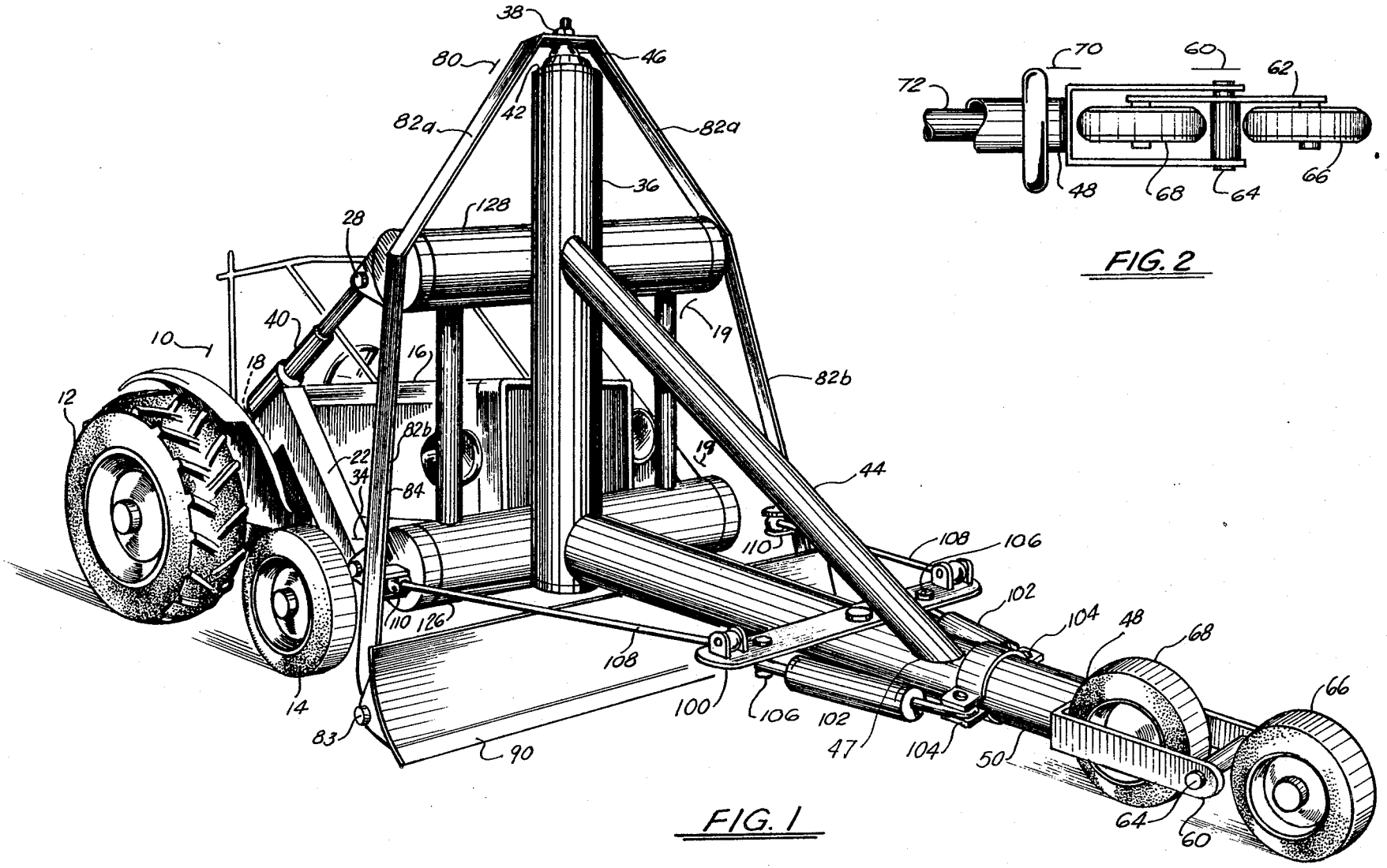
FIG. 1 is a front perspective view of a tractor grader attachment in accordance with the present invention mounted to a tractor.
FIG. 2 is a top view of the tandem front wheels of FIG. 1.

Referring to the drawings, the inventive mechanism may be seen in two embodiments, an initial test embodiment and a preferred configuration embodiment, mounted to a tractor 10. What I refer to as the short wheel base orientation of tractor 10 is established by the relative contact of its rear wheels 12, which provide the driving traction force, and its front wheels 14, which provide the steering effort; both of these wheel sets provide positioning for the body 16 of the tractor.

The apparatus is attached to tractor 10 through Front End Loader Mechanism 18. Throughout this description, I have used for illustration a figurative four point front end hitch, comprising support arms 22, hydraulic actuating cylinders 40 for manipulating support structure 19 defined by lower transverse truss support 126, upper transverse truss support 128, and their associated unnumbered vertical supports.

Such structures are well understood and known for supporting and manipulating accessories for tractors, and thus are not further defined. It is understood that such mechanisms have the capability of moving an attachment vertically, and also of tilting the attachment. For the purposes of illustrating my invention, I have defined the point of rotation of such tilting action as pivoting attachment point 34; it should be understood that vertical lifting motions when referred to are with respect to attachment point 34, although by the known design of front end loader mechanisms, the entire associated support structure (and thus the inventive apparatus fastened to it) moves in a coordinated fashion under the control of an operator of the tractor.

It should also be understood that the invention herein described is equally supportable upon and therefore applicable to a three point hitch front end loader mechanism. Those skilled in the Tractor art will readily see how such an adaption may be made.

Support truss 32 provides the basic frame of the invention. Support truss 32 is in basic form a delta truss or a half truss, the lower rear end of the truss being defined by pivoting attachment point 34. The lower rear end of the truss is pivotally mounted at pivoting attachment point 34 so that truss 32 may rotate with respect to support arms 22.

A vertical or upper member 36 arises from pivot attachment point 34 extending from pivot end 34 of the truss to an upper end 42 of the truss. Upper member 36 is further attached to support arms 22 through offset mounted second hydraulic cylinder actuators 40. Actuation of second hydraulic cylinders 40 acts to tilt upper member 36 and therefore, the entire support truss 32 about pivot attachment 30 with respect to support arms 22.

Upper end 42 defines a highest point of support truss 32. It is preferable that this be a relatively high point with respect to the overall size of the truss, and relatively should be at least half the overall length of support truss 32 from its pivot end 34 to a forward end 48. Upper end 42 forms the support for two degree of freedom hanger support 46.

Forward support member 44 is a support beam extending forward and downward from a point on upper member to a forward point 47 on truss 32, forming the upper structural support and brace for the truss 32. At point 47, forward support 44 connects with main truss beam 50, which extends from pivot end 34 to a forward end 48. Main beam 50 is the third member, bracing and forming truss 32 in combination with forward support 44 and upper member 36.

At forward end 48 is mounted truss wheel support 60, a ground contacting wheel assembly supporting the forward end of truss 32 against the ground. Wheel support 60 acting through support truss 32, support arms 22 and tractor body 16 forms a lever arm extending from wheel support 60 to rear wheels 12.

In the preferred embodiment, wheel support 60 comprises a forward and rearward extending pivoting wheel bar 62, pivotally attached to forward end 48 at pivot point 64. Wheel bar 62 thereby defines a forward and rear end having a front wheel 66 at the forward end thereof and a rear wheel 68 at the rear end thereof. It has been found preferable that, in distinction to the prior art dual pivoting wheel structures, that only a single front wheel 66 and a single rear wheel 68 be utilized so as to provide for tilting as described below.

Support truss 32 provides an elongated lever arm for the entire grader and tractor assembly as above described. In addition, it provides an upper support for a blade hanger 80, which extends in a vertically suspended direction from a point of attachment at truss upper end 38 downwards, supportingly holding blade 90. The connection between truss upper end 38 and blade hanger 80 is two degree of freedom (twist and side-to-side motion) connection 46. Two degree of freedom hanger support 46 may be any suitable joint known to the art. In a prototype embodiment it is a rotational joint with a separate, right angled rotational joint as in a tie rod end. In the preferred embodiment, it is a substantially strong ball joint supporting the weight of hanger frame 80 and blade 90.

In the described embodiment of the invention, it is felt that the best form of hanger 80 is a pentagonal frame comprising first and second substantially strong upper side members **82*a*, formed of steel bar or the like, each extending from hanger support 46 downwards to and connected to a second vertical side member 82*b*, which extends downwards to a point 83, fixedly attached to blade 90**, forming the base of the pentagonal structure.

This form of the hanger 80 is constrained by the existance of upper transverse support 128, which as mentioned above, is a feature of four point hitches. If a three point hitch were to be used, hanger 80 would be best formed of a triangular frame structure, comprising two diverging side frame members, of steelbar or the like, extending straight from hanger support 46, downward to a point of attachment 83 to blade 90.

In either case, point of attachment 83 between hanger 80 and blade 90 is preferably a pivoting connection, so that blade 90 may be pivoted in its angle of cut by blade pivot mechanism 85. Mechanisms for setting the angle of cut of a scraper blade are old in the art and any such is suitable for the purpose; what is illustrated is a curved, serrated clamp, of the type secured by a bolt and nut at varying positions.

Figures 3, 4:
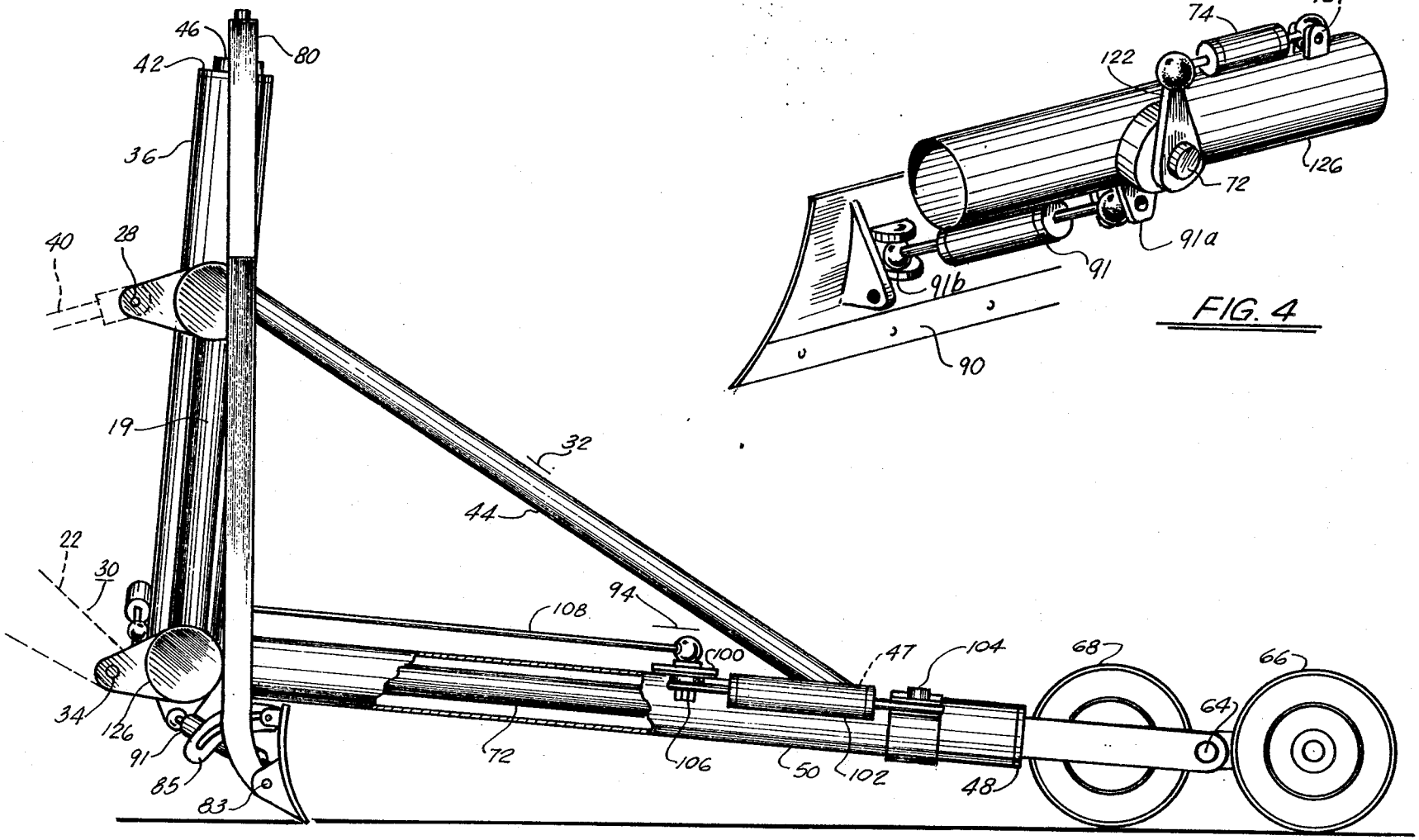
FIG. 3 is a side view of the grader attachment of FIG. 1.
FIG. 4 is a perspective view of a portion of the attachment showing an actuator for angling the front wheels and an actuator for providing side-by-side translation of the blade.

It should be noted that the position of blade 90 should be sufficiently in front of lower transverse support 126 so that, upon setting of the blade angle rotation as described below, no contact will occur between the more rearward end of blade 90 and associated support structure 19. FIG. 3 depicts the maximum rearward positioning recommended for blade 90 when tilted.

The entire weight of blade 90 is supported by hanger frame 80. Blade 90 is provided with a first side to side transverse movement means, transverse to the direction of main beam 50.

In the described embodiment, side-by-side translation is preferably provided by hydraulic actuator 91, pivotally attached to main beam 50 at actuator attachment **91*a* and pivotally attached to blade 90 at second pivot attachment 91*b*. These pivotal attachments are preferably ball and socket joints, adapting to the varied movements possible for blade 90**.

Blade 90 is further provided with the means of rotating its angle with respect to a perpendicular to main beam 50 by means of a rotational actuation means 94. In the preferred embodiment, the rotation actuation means 94 comprises first an idler bar 100, pivotally affixed transverse to main beam 50. Idler bar 100 is changed in angle to main beam 50 by means of a balanced pair of hydraulic actuators 102 interconnected between beam attachment point 104 and bar attachment point 106 in push-pull relationship.

The use of a balanced pair of push-pull hydraulic actuators 102 is considered preferable because of the unbalanced impact loads likely to be encountered by the blade when it is rotated to a leading edge position. Any rock or obstacle which is struck off center by the blade 90 will produce a countering, counter rotating force against the blade 90 which will be transmitted back through linkage arms 108 into link idler bar 100, producing a counter-torque about idler bar 100. The use of balanced hydraulic actuators serves to reduce the resulting stresses imposed upon idler bar 100; were only a single hydraulic actuator 102 to be used, idler arm 100 would have to be of substantially stouter construction to resist bending movements, and a significant shearing force might be imposed upon pivoting attachment point 110; the use of balanced hydraulic actuators 102 avoids these forces and reduces the bending force on idler bar 100. Nevertheless, a functioning prototype has been made with only a single, although significantly strong positioning means 94.

One or more pivoting linkage arms 108 are pivotally attached to idler bar 100 at a first end and extend back, pivotally attached to hanger frame 80 at attachment points 110. Preferably there are two such linkage arms, one on each side of main beam 50, running substantially parallel to one another to provide a balanced rotational force to hanger frame 80 and thus to blade 90.

In use, the attachment being fastened as described above, the standard grader motions of the blade are: first, lifting and lowering the blade with respect to the ground for depth of cut; second, rotating the blade to establish a leading edge so as to direct the spoil to one side; and, third, angling the blade with respect to the ground so as to provide for a crowned effect for drainage. In the prior art, these motions require relatively complex blade manipulation structures and the entire blade is supported through a relatively short arm relatively heavyweight ring and actuator structure, all of which must be raised and lowered.

By contrast, in the structure of the current invention, the blade is lifted by manipulation of support arm 22 actuator (not shown) and truss actuator 40 in coordination with each other so as to pivot truss 32 with respect to tractor 10 about pivot attachment point 30. This modified the truss geometry, which is still maintained in a modified, rigid alignment, along the lever arm formed between wheel support point 60 and rear wheels 12 raising and lowering blade 90 as it is suspended from hanger 80.

By suspending blade 90 from hanger 80 from a point having a substantial radius of curvature, it is found that a preferred movement of blade 90 occurs in which blade 90 remains tangent to a circle having a radius equal to the distance from truss upper end 38 to blade 90. It is found that this produces a more uniform and suitable cut than the prior art ring and tilt actuator mechanism at a considerable saving in weight and mechanism as a single translation structure is suitable for providing a tilted cut angle to blade 90. Likewise, this rotation mechanism, since it is not required to support blade 90 and is not required to support or actuate the tilt mechanism, can be made of much lighter weight and much simpler construction.

In distinction to the prior art, the apparatus is steered by means of tractor steering apparatus, whether wheels 14, or an articulated steering system, as known for larger units. This eliminates the need for a steering mechanism in the grader attachment with associated controls interconnected with the tractor.

It has been found preferable that a tilting mechanism be provided for tilting tandem front wheel 60 at an angle so as to aid in the production of smooth curves.

In the preferred embodiment of the invention, tilt mechanism 70 is achieved by attaching tandem wheels 60 to the forward end of an elongated internal torque tube 72 extending, rotationally supported by bearings (not shown) within main support tube 50 from a forward end 48, through and emitting from lower transverse truss support 126, behind and above pivoting attachment point 30. It can be seen therefore, that rotation of wheel torque tube 72 rotates tandem wheel support 60 and therefore, tandem wheels 66, 68 rotate about an axis of main beam 50. The degree of rotation is established by hydraulic rotation actuator 74, which may be any suitable actuator, connected between rotation clevis 122, a fixed lever arm attachment on the rear of torque tube 72 to provide a torque thereto, and base attachment point 124 on lower transverse truss support member 126.

As shown above, the associated support mechanism 19, here shown as lower transverse truss support 126 and upper transverse truss support 128 are illustrative of the form of the invention adapted to a four point hitch; for a three point hitch, upper transverse truss support 128 would be omitted, the upper pivot mounting 28 being centrally affixed by clevis or the like to upper member 36.

It should thus be apparent from the description herein given that many detailed embodiments are possible and, therefore, the scope of the invention is limited not to the detailed description herein given but rather to that wider range of embodiments inherent in the claims.

I claim:

1. An apparatus to adapt a relatively short wheel base tractor to a long wheel base road grader comprising:

(a) first support arm means, pivotally affixed to said tractor;

(b) first tilt means adapted to rotate said first arm means with respect to said tractor;

(c) frame means pivotally affixed at a forward end of said support arms means, said frame means defining a first axis of said apparatus which is longitudinally aligned with said tractor;

(d) second tilt means for tilting said frame means about said forward end of said support arm means;

(e) wheel support means at the tip of said frame means distal from said forward end;

(f) a blade support frame pivotally affixed to an upper end of said frame means, vertically depending therefrom;

(g) blade means horizontally affixed at a lower end of said support frame;

(h) means, interconnecting said frame means and said blade means, for translating said blade means generally transverse to said first axis of said frame means; and (i) means associated with said frame means for angling said blade means about a second generally vertical axis.

2. The apparatus of claim 1 in which said wheel support means further comprise:

(a) a wheel axis bar member pivotally affixed to a forward end of said frame extending in a fore and aft direction with respect thereto;

(b) a first wheel pivotally affixed to a forward end of said bar;

(c) a second wheel pivotally affixed to the rear of said bar;

(d) said wheel bar being rotationally mounted to said frame means for rotation axially around said first axis.

3. The apparatus as described in claim 2 above, wherein the said wheel support means further comprise:

(a) means for rotatably positioning said wheel support means axially around said first axis whereby said wheels may be selectively positioned at an angle to the ground.

4. The apparatus as described in claim 3 above, wherein said positioning means further comprises:

(a) a rotational joint pivotally interconnecting said frame means and said bar member;

(b) hydraulic actuator means extending from a point on said frame means to a lever arm extending from said bar member;

(c) the lever arm being laterally spaced from said point on said frame means.

5. An apparatus for grading a roadway comprising:

(a) a truss frame extending the an elongate direction having an upper end, a forward end and a rear end;

(b) said truss frame being spaced so that the distance between the rear end and the upper end is a substantial fraction of the distance between the rear end and the forward end;

(c) said truss frame being pivotally affixed to a motored power means at said rear end;

(d) said truss frame having supporting wheel means upon said forward end;

(e) scraper blade means intermediate said forward and said rear end of said truss frame, beneath said truss frame, being pivotally suspended by a hanger frame from said upper end.

said scraper blade means further comprising:

(f) means interconnecting said blade and said truss frame for pivoting said blade with respect to said truss frame;

(g) said truss frame defining a fore and aft direction;

(h) second means interconnecting said blade and said truss frame for translating said blade in a generally transverse direction with respect to said fore and aft direction.

6. The apparatus as described in claim 5 above, where said hanger frame further comprises:

(a) a two degree of freedom pivot interconnecting an upper end of said truss frame and an upper end of said hanger frame;

(i) said hanger frame comprising a first and a second tension support bar extending from said pivot to a first and a second point upon said blade.

7. The apparatus as described in claim 5 above, further comprising:

(a) first means for vertically positioning said rear end with respect to said tractor means; and (b) a second means for raising said truss frame vertically above said tractor means.

8. The apparatus as described in claim 5 above, wherein said blade further comprises:

(a) means for positioning said truss frame at a first position substantially above said power means;

(b) means for positioning said truss frame at a second position in a fixed, angular relationship to said power means;

(c) means interconnecting said blade and said truss frame for pivoting said blade with respect to said truss (d) second means interconnecting said blade and said truss frame for translating said blade in a generally transverse direction with respect to said forward axis.

9. The apparatus as described in claim 8 above, wherein said hanger frame further comprises:

(a) a two degree of freedom pivot interconnecting an upper end of said truss frame and an upper end of said hanger frame;

(b) said hanger frame comprising a first and a second tension support bar extending from said pivot to a first and a second pivot point upon said blade.

10. An apparatus to adapt a relatively short wheel base tractor to a long wheel base road grader comprising:

(a) first support arm means, pivotally affixed to said tractor;

(b) first tilt means adapted to rotate said first arm means with respect to said tractor;

(c) frame means pivotally affixed at a forward end of said support arm means, said frame means defining a first axis of said apparatus which is longitudinally aligned with said tractor;

(d) second tilt means for tilting said frame means about said forward end of said support arm means;

(e) wheel support means at the tip of said frame means distal from said forward end;

(f) a blade support frame pivotally affixed to an upper end of said frame means, vertically depending therefrom;

(g) blade means horizontally affixed at a lower end of said support frame;

(h) means, interconnecting said frame means and said blade means, for translating said blade means generally transverse to said first axis of said frame means;

(i) means associated with said frame means for angling said blade means about a second generally vertical axis;

(j) a wheel axle bar member pivotally affixed to a forward end of said frame extending in a fore and aft direction with respect thereto;

(k) a first wheel pivotally affixed to a forward end of said bar;

(l) a second wheel pivotally affixed to the rear of said bar;

(m) said wheel bar being rotationally mounted to said frame means for rotation axially around said first axis;

(n) means for rotatably positioning said wheel support means axially around said first axis whereby said wheels may be selectively positioned at an angle to the ground;

(o) a rotational joint pivotally interconnecting said frame means and said bar member;

(p) hydraulic actuator means extending from a point on said frame means to a lever arm extending from said bar member; and (q) the lever arm being laterally spaced from said point on said frame means.

11. An apparatus for grading a roadway comprising:

(a) a truss frame extending in a elongate direction having an upper end, a forward end and a rear end;

(b) said truss frame being spaced so that the distance between the rear end and the upper end is a substantial fraction of the distance between the rear end and the forward end;

(c) said truss frame being pivotally affixed to a motored power means at said rear end;

(d) said truss frame having supporting wheel means upon said forward end;

(e) scraper blade means intermediate said forward and said rear end of said truss frame, beneath said truss frame, being pivotally suspended by a hanger frame from said upper end;

said blade further comprising:

(f) means interconnecting said blade and said truss frame for pivoting said blade with respect to said truss frame;

(g) said truss frame defining a fore and aft direction;

(h) second means interconnecting said blade and said truss frame for translating said blade in a generally transverse direction with respect to said fore and aft direction;

(i) a two degree of freedom pivot interconnecting an upper end of said truss frame and an upper end of said hanger frame;

(i) said hanger frame comprising a first and a second tension support bar extending from said pivot means to a first and a second point upon said blade.

12. An apparatus for grading a roadway comprising:

(a) a truss frame extending in a elongate direction having an upper end, a forward end and a rear end;

(b) said truss frame being spaced so that the distance between the rear end and the upper end is a substantial fraction of the distance between the rear end and the forward end;

(c) said truss frame being pivotally affixed to a motored power means at said rear end;

(d) said truss frame having supporting wheel means upon said forward end;

(e) scraper blade means intermediate said forward and said rear end of said truss frame, beneath said truss frame, being pivotally suspended by a hanger frame from said upper end;

(f) means for positioning said truss frame at a first position substantially above said power means; and (g) means for positioning said truss frame at a second position in a fixed, angular relationship to said power means;

(h) means interconnecting said blade and said truss frame for pivoting said blade with respect to said truss frame;

(i) second means interconnecting said blade and said truss frame for translating said blade in a transverse direction with respect to said forward axis;

(j) a two degree of freedom pivot interconnecting an upper end of said truss frame and an upper end of said hanger frame;

(k) said hanger frame comprising a first and a second tension support bar extending from said pivot to a first and a second point upon said blade.

* * * * *